United States Patent [19]

Williams

[11] Patent Number: 4,595,161

[45] Date of Patent: Jun. 17, 1986

[54] TUBE BUNDLE SUPPORT

[76] Inventor: George J. Williams, 36 Hickory La., Chalfont, Pa. 18914

[21] Appl. No.: 665,707

[22] Filed: Oct. 29, 1984

Related U.S. Application Data

[62] Division of Ser. No. 499,831, Jun. 1, 1983.

[51] Int. Cl.[4] ..... F16L 3/22

[52] U.S. Cl. ..... 248/68.1; 165/162

[58] Field of Search ..... 248/68.1; 165/162; 52/664, 668

[56] References Cited

U.S. PATENT DOCUMENTS

| | | | |
|---|---|---|---|
| 1,790,817 | 2/1931 | Jacobus | 165/162 |
| 1,842,945 | 1/1932 | Price et al. | 165/162 X |
| 2,581,121 | 1/1952 | McCurdy et al. | 165/162 X |
| 2,849,943 | 9/1958 | Zurawski | 52/668 X |
| 3,820,594 | 6/1974 | Ritland et al. | 165/162 X |
| 4,282,695 | 8/1981 | Lew | 52/664 X |
| 4,452,025 | 6/1984 | Lew | 52/668 |

FOREIGN PATENT DOCUMENTS

| | | | |
|---|---|---|---|
| 599786 | 11/1959 | Italy | 52/664 |

*Primary Examiner*—Ramon S. Britts
*Assistant Examiner*—David M. Purol
*Attorney, Agent, or Firm*—Joseph W. Molasky & Assocs.

[57] ABSTRACT

A supporting means for the tubes in a tube bundle arranged in an array having a plurality of rows of parallel tubes with lanes therebetween is constructed of a plurality of first and second strip members extending through lanes of the bundles, with the lanes through which the first strip members extend being transverse to the lanes through which the second strip members extend, and a frame extending around the periphery of the tube bundle array in engagement with the strip members for retaining the same in place.

4 Claims, 8 Drawing Figures

FIG. 2
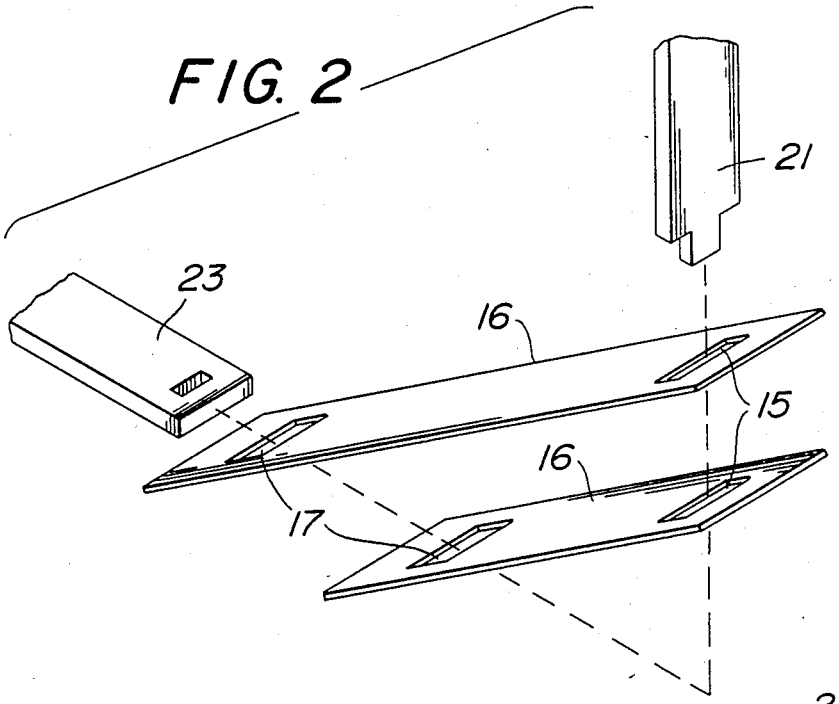
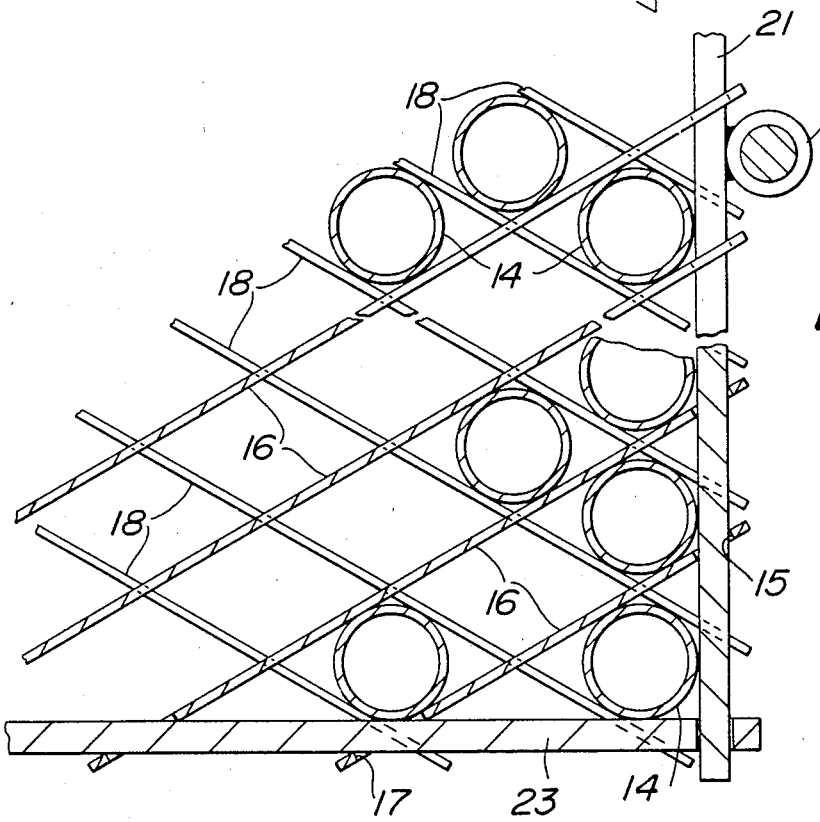
FIG. 4

FIG. 6
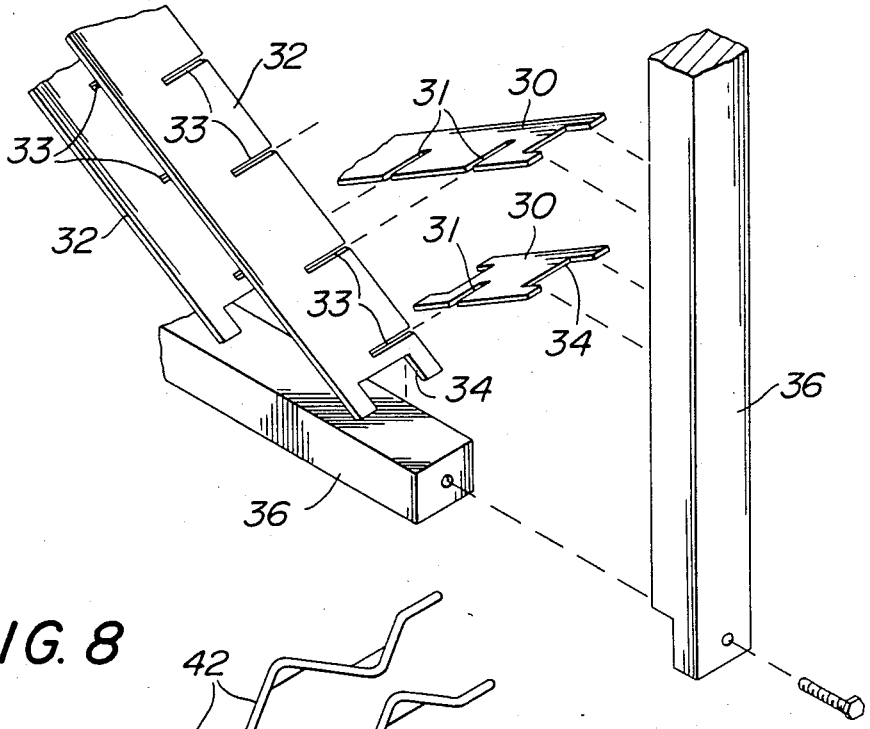
FIG. 8
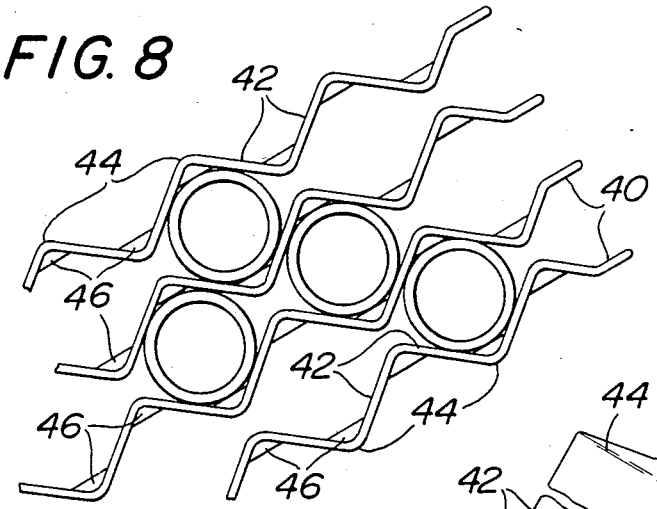
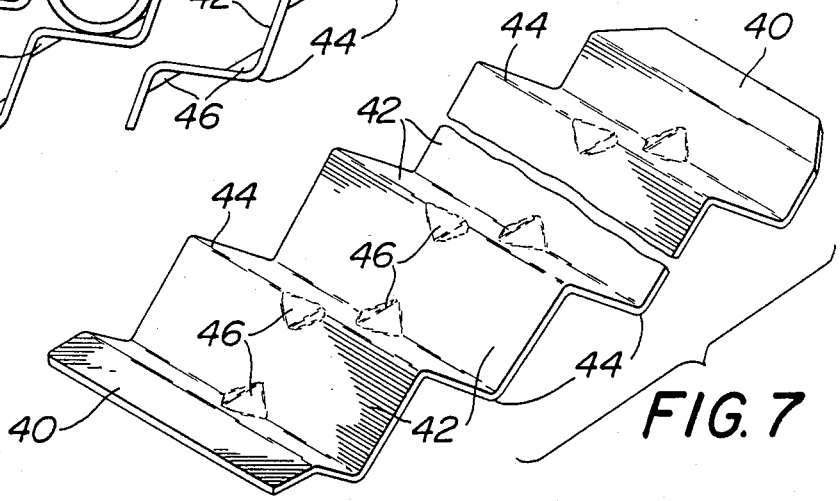
FIG. 7

TUBE BUNDLE SUPPORT

This is a division of copending application Ser. No. 499,831, filed June 1, 1983.

BACKGROUND AND SUMMARY OF THE INVENTION

The invention relates to supporting means for the tubes in a tube bundle or the like arranged in an array having a plurality of rows of parallel tubes extending between spaced apart support plates and having lanes between the rows of the tubes.

In the use of tube bundles of the type employed in surface condensers, heat exchangers and similar apparatus, the damage caused by vibration of the tubes can be a serious problem. A method called "staking" has been used to diminish the vibration in tube bundles of the indicated type, this method involving the pushing of flat bars between the tubes. However, this method of staking has not been entirely successful in reducing vibration since the flat bars are inserted in a random and uncontrolled pattern and often slip from their inserted position.

It is the general object of the invention to provide a supporting system of non-load carrying members which reduces the damage caused by vibration in tube bundles of the indicated type.

Briefly stated, the supporting means in accordance with the invention comprises a plurality of first and second strip members extending through lanes of the bundles to provide supporting contact for the tubes, the lanes through which the first strip members extend being transverse to the lanes through which the second strip members extend, and frame means extending around the periphery of the array of the tube bundle in engagement with the strip members for retaining the same in place.

The supporting means of the invention thus provides a specific, controlled pattern of strips for supporting the tube bundles as opposed to the random placement of the "staking" method. Moreover, the position of the strip members can be set and maintained at or near the mid-span of the tube bundle support plates where the vibration is the most serious.

There are provided several embodiments of the invention so that the supporting means can be applied at the time of retubing or retro-fitting of a tube bundle or while the tube bundles are intact. One embodiment of the invention comprises a strip member which can be applied to an in-place tube bundle whose size and tube pattern make it impractical to use the perimeter frame. In this case, a specially formed strip of high strength metal is designed so that it can slide between the tubes longitudinally but cannot rotate about its planer axis.

All of the embodiments of the invention are inexpensive, readily installed and involve no structural changes to the tube bundle or the containment therefor.

BRIEF DESCRIPTION OF THE DRAWINGS

FIG. 2 is a fragmentary view of the supporting means shown in FIG. 1 illustrating the manner in which the frame is engaged with the strips.

FIG. 4 is a sectional view taken on line 4—4 of FIG. 3.

FIG. 6 is a fragmentary exploded view showing the manner in which the lattice structure shown in FIG. 5 is assembled.

FIG. 7 is a perspective view of a strip member in accordance with a third embodiment of the invention.

FIG. 8 is a view showing the installation of the strip member shown in FIG. 7 in a tube bundle.

DETAILED DESCRIPTION OF THE PREFERRED EMBODIMENTS

Figure 1:
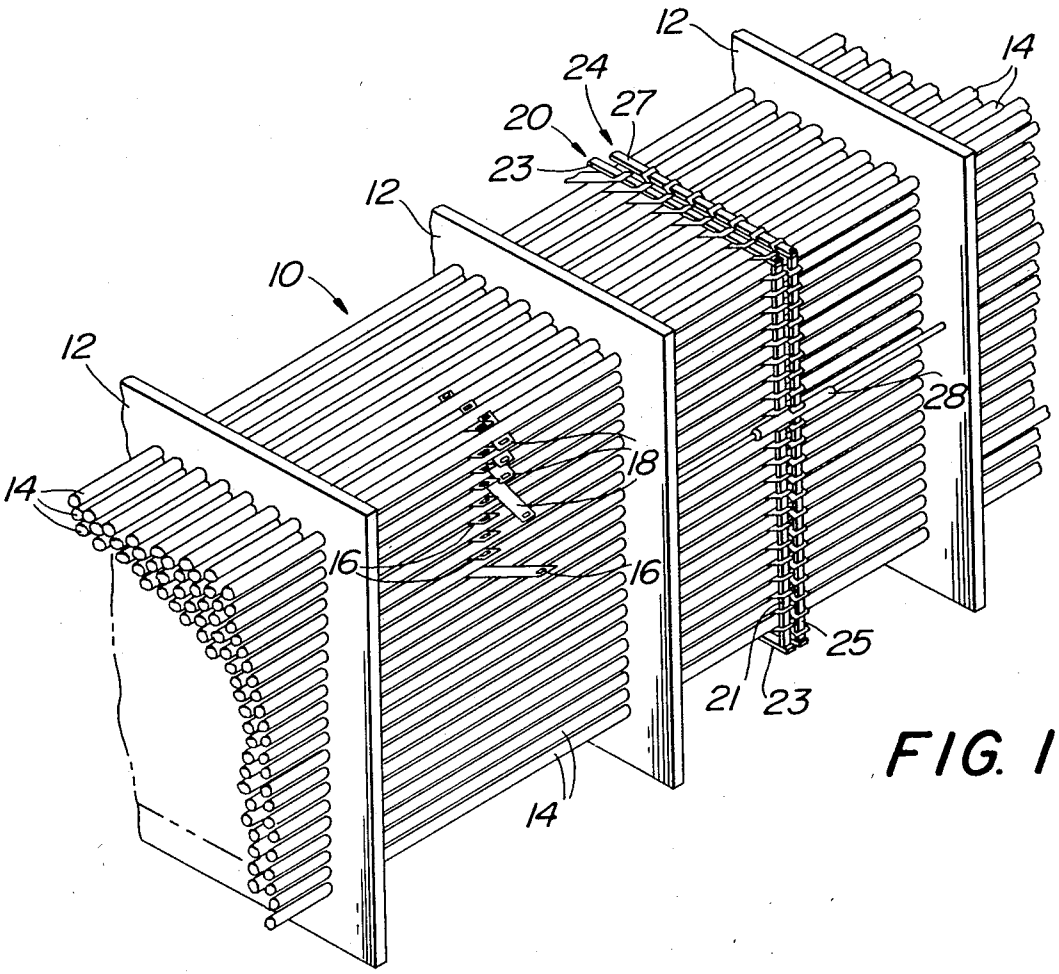
FIG. 1 is a perspective view showing a tube bundle having one type of supporting means in accordance with the invention installed between support plates therefor.

In FIG. 1 there is shown a typical tube bundle 10 to which the supporting means of the invention is applied. Tube bundle 10 is supported at longitudinally spaced apart locations by support plates 12 which, conventionally, are provided with an array of drilled holes through which the individual tubes 14 of tube bundle 10 extend. Tubes 14 of tube bundle 10 are arranged in an array having a plurality of rows of parallel tubes extending between support plates 12 and having open lanes between the tube rows. As is conventional in tube bundle design, there are provided a first group of parallel lanes which extend transversely to a second group of parallel lanes.

The supporting means of the invention shown in FIGS. 1–4 comprises a plurality of first strip members 16 extending through the first group of lanes in tube bundle 10 to provide supporting contact for tubes 14 and a plurality of second strip members 18 extending through the second group of lanes in tube bundle 10 to provide supporting contact for tubes 14. As is viewed in FIG. 4, strip members 16 extend downwardly from right to left through tube bundle 10 while strip members 18 extend upwardly from right to left through tube bundle 10 whereby strip members 16 and 18 extend transversely to one another.

Strip members 16 and 18 are preferably made of flat bars of a high strength metal, such as carbon steel or stainless steel. Other suitable materials may, of course, be used.

Referring to FIG. 1 wherein a completed supporting means is shown in the upper right hand portion thereof, it is noted that the strip members 16 and 18 are slipped between adjacent rows of tubes 14 through the lanes thereof at or near the mid-span between a pair of adjacent support plates 12. The strip members 16 and 18 are located adjacent to one another such that two parallel rows of flat strips are formed abutting at their side edges. FIG. 1 also illustrates the manner in which the rows of strip members 16 and 18 are slipped into tube bundle 10 individually to form the parallel rows of strips.

A frame 20 extends around the periphery of tube bundle 10 in engagement with the ends of strip members 16 for retaining the same in place. To this end, each strip member 16 is provided with slots 15 and 17, each slot being located near one of its ends. Slots 15 and 17 are spaced slightly inwardly from the ends of a strip 16 and are elongated transversely as is best shown in FIG. 2. Slots 15 and 17 are of a different width and are adapted to receive vertical and horizontal frame members 21 and 23, respectively, of frame 20 as is shown in FIGS. 2 and 4.

A frame 24 extends around the periphery of tube bundle 10 in engagement with the ends of strip members 18 for retaining the same in place. Strip members 18 are identical in construction to strip members 16 and are also provided with similar end slots 15 and 17 for receiving vertical and horizontal frame members 25 and 27, respectively, of frame 24. It will be noted that the strip members 16 and 18 will be oriented in a manner such that the slots 15 and 17 can properly receive the engaging frame members therefor.

Figure 3:
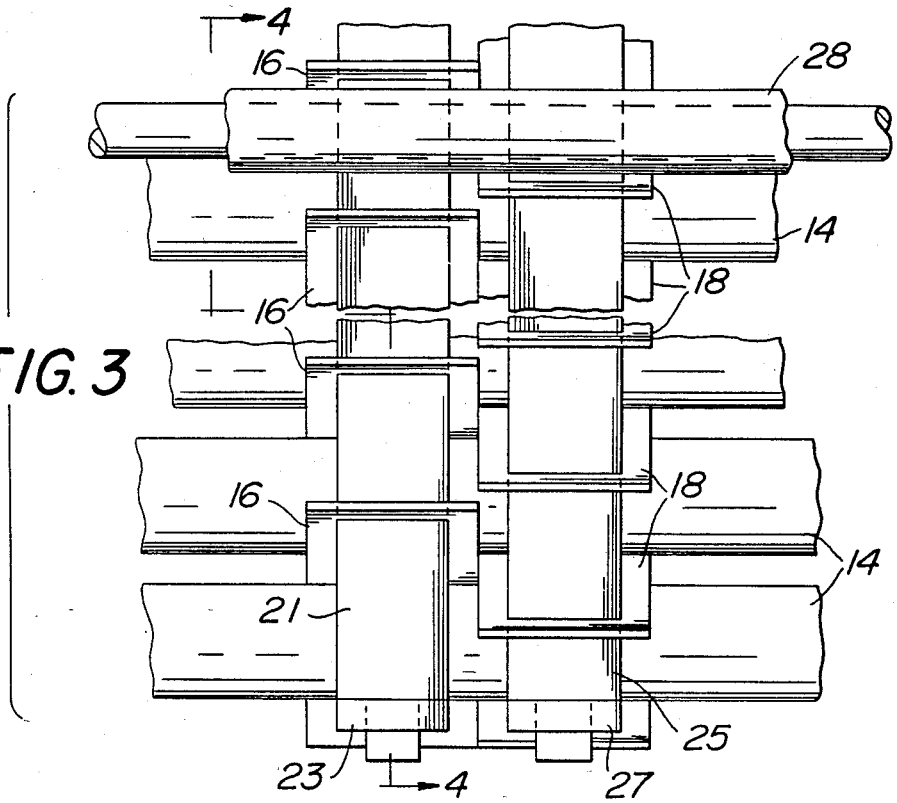
FIG. 3 is a fragmentary end view of the lower portion of a supporting means shown in FIG. 1.

Frame 20 for strip members 16 comprises two vertical frame members 21 and two horizontal frame members 23 interlocked at their ends as is best shown in FIGS. 2 and 3. The vertical and horizontal frame members extend through associated slots 15 and 17 so as to engage strip members 16 snd retain them in place in a frame-like structure.

Frame 24 for strip members 18 is similar to frame 20 for strip members 16 and comprises a pair of horizontal and vertical frame members 25 and 27 which extend through associated slots 15 and 17 in the ends of strip members 18 in the same manner as the frame construction for strip members 16 described above.

By this arrangement, there is provided a frame means extending around the periphery of the array of tube bundle 10 in engagement with strip members 16 and 18 for retaining the same in place in their tube supporting position as is best shown in FIG. 1. As described above, the strip members 16 and 18 and the frames 20 and 24 therefor are located in side-by-side relation and preferably are at the midspan between a pair of adjacent support plates 12.

Means are provided for maintaining the position of the strip members 16 and 18 at the mid span between a pair of adjacent support plates 12. To this end, there is provided a spacer bar 28 secured in place between the adjacent support plates 12 and attached to the frame means as by welding as is best shown in FIGS. 1 and 4.

It is noted that each of the frames 20 and 24 is affixed to the associated strip members 16 and 18 after they all have been inserted through the lanes of tube bundle 10 into their tube supporting position. The completed structure thus forms a frame-like retainer which is formed to the approximate shape of the outermost tube pattern. As is best shown in FIG. 4, strip members 16 and 18 provide an excellent support structure for the individual tubes 14 of tube bundle 10. Depending on the dimensions and configuration of the tube bundle and the tubes therein, the strip members 16 and 18 can contact the tubes 14 at four circumferentially spaced locations to provide support therefor. The amount of contact will depend on the tube bundle configuration.

The embodiment of the invention shown in FIGS. 1–4 has been described as a supporting means which is applied to a tube bundle already intact. However, this arrangement could be applicable to a tube bundle which is either being retrubed or retrofitted.

Figure 5:
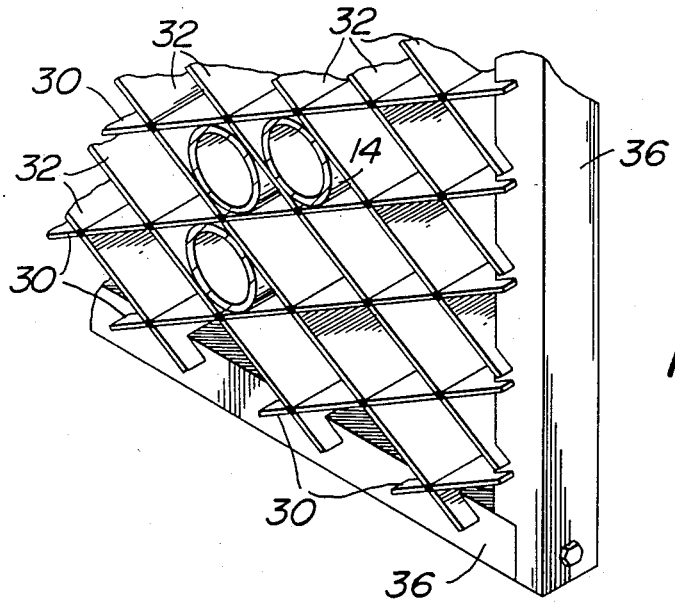
FIG. 5 is a fragmentary perspective view of a second embodiment of the invention comprising strip members arranged in a lattice structure.

In FIGS. 5 and 6 there is shown a supporting means in accordance with the invention which is applied to new tubing either during a retubing or a retrofitting operation. This supporting means comprises a lattice structure made by interlocking flat strips of suitable material, such as stainless or carbon steel. When made of metal, the strips are spot welded at their intersections.

As will be described in detail hereafter, when assembly of the lattice structure is completed, it is locked into a frame-like retainer in a manner similar to that described for the embodiment shown in FIGS. 1–4. However, if desired, the lattice like structure can be used without a frame means since it is a free standing assembly.

The embodiment of the invention shown in FIGS. 5 and 6 comprises a plurality of first strip members 30 constructed and arranged to extend through the lanes of a tube bundle to provide supporting contact for the individual tubes and a plurality of second strip members 32 constructed and arranged to extend through the tube bundle transversely to the first strip members 30 to provide supporting contact for the tubes as is best shown in FIG. 5. Strip members 30 and 32 are interlocked at cooperating slots 31 and 33, respectively, formed therein, to form a lattice structure of crossed strips with parallelogram-shaped openings therebetween for receiving the tubes, as best shown in FIG. 5. The assembly is like the well known "egg crate" structure.

Means are provided for securing strip members 30 and 32 together in a free standing lattice structure as shown in FIG. 5. To this end, the strip members 30 and 32 are joined together at their intersections by spot welds when they are made of metal. It will be apparent that if the strips are made of a non-metallic material, suitable adhesives or cements can be used to join the crossed strips at their intersections.

Preferably, the means for securing strip members 30 and 32 together include a framework extending around the periphery of the array of the tube bundle in engagement with the ends of strip members 30 and 32. To this end, strip members 30 and 32 are provided with recesses or notches 34 in the ends thereof adapted to receive the frame members 36 of the framework. The manner in which strip members 30 and 32 are assembled together and with the frame members 36 is best shown in FIG. 6.

In FIGS. 7 and 8 there is shown a supporting means which can be applied to support the tubes of an in-place tube bundle whose size and/or tube pattern make it impractical to use a perimeter frame means as shown in the embodiments of FIGS. 1–4 and FIGS. 5 and 6 as described above. To this end, there are provided a plurality of strip members 40 adapted to extend through the lanes of a tube bundle to provide supporting contact for the tubes. Each strip member 40 consists of an elongated strip of metal corrugated to provide a series of transversely extending undulated folds 42 forming successive transverse bends 44 in alternate directions. Depressions 46 are formed in each of the apexes to strengthen strip member 40 at this location.

Each of the strip members 40 is constructed to be inserted into the tube bundle array as shown in FIG. 8 from the exterior thereof by sliding through a lane between adjacent rows of the tubes. Each strip member 40 has adjacent folds 42 having the V-shaped cross-section joined at a transversely extending apex constructed so that a substantial portion of a tube is cradled therebetween and so that the strip member 40 is maintained in a position extending transversely to the direction the tubes extend between the support plates. By reason of this construction, a strip member 40 may possibly slide longitudinally along the length of the tubes, but it cannot rotate about its planer axis and as a result slip down between the tubes and out of the bundle as is the case with the prior art flat stakes.

Strip members 40 will preferably be formed either of stainless steel or a high strength metal such as carbon steel coated with a low friction material such as Teflon. The low friction material will help to reduce the friction that occurs when a strip is pushed through the tube bundle.

What is claimed is:

1. Supporting means in combination with tubes in a tube bundle or the like arranged in an array having a plurality of rows of parallel tubes extending between spaced apart support plates and having lanes between the rows of tubes comprising:

a plurality of first strip members extending through the lanes of the bundles to provide supporting contact for the tubes, a plurality of second strip members extending through lanes of the bundles to provide supporting contact for the tubes, the lanes through which the first strip members extend being transverse to the lanes through which the second strip members extend, and frame means extending around the periphery of the array of the tube bundle in engagement with said strip members for retaining the same in place, said frame means including a first frame in engagement with the ends of said first strip members and a second frame in engagement with the ends of said second strip members, said first strip member having slots in the ends thereof and said first frame comprising frame members extending through said slots, said second strip members having slots in the ends thereof and said second frame comprising frame members extending through said slots.

2. Supporting means according to claim 1 wherein said strip members are set in a position between and in spaced apart relation to the support plates, and including means for maintaining the set position of said strip members.

3. Supporting means according to claim 2 wherein said means for maintaining the set position of said support plates comprises a spacer bar secured in place between the support plates for the tubes and attached to said frame means.

4. Supporting means according to claim 1 wherein said first and second strip members are located in side-by-side relation.

* * * * *